US008844884B2

(12) United States Patent
Bottazzi

(10) Patent No.: US 8,844,884 B2
(45) Date of Patent: Sep. 30, 2014

(54) WHEELED STRUCTURE FOR LONG ARM TOOLS CONNECTED TO A SUCTION BLOCK INCLUDING A TILT DEVICE

(75) Inventor: Marc Bottazzi, Saint Vincent de Boisset (FR)

(73) Assignee: M. B. H. Developpement, Saint Romain la Motte (FR)

( * ) Notice: Subject to any disclaimer, the term of this patent is extended or adjusted under 35 U.S.C. 154(b) by 274 days.

(21) Appl. No.: 13/438,401

(22) Filed: Apr. 3, 2012

(65) Prior Publication Data

US 2013/0074966 A1 Mar. 28, 2013

(30) Foreign Application Priority Data

Sep. 23, 2011 (FR) ..... 11 58487

(51) Int. Cl.
*B24B 7/18* (2006.01)
*B24B 23/00* (2006.01)
*B24B 55/10* (2006.01)

(52) U.S. Cl.
CPC ..... *B24B 7/184* (2013.01); *B24B 23/005* (2013.01); *B24B 55/10* (2013.01)
USPC ..... 248/122.1; 248/286.1; 280/35; 280/47.34

(58) Field of Classification Search
CPC .. B25H 1/0035; B25H 1/0028; A47L 9/0036; A47L 9/0045; A47L 9/009; B24B 7/184; B24B 7/18
USPC ..... 248/122.1, 124.1, 129, 128, 133, 136, 248/284.1, 286.1; 414/11; 137/899; 451/353; 280/35, 651, 652, 47.34
See application file for complete search history.

(56) References Cited

U.S. PATENT DOCUMENTS

| | | | | |
|---|---|---|---|---|
| 2,168,121 | A * | 8/1939 | French | 15/144.1 |
| 2003/0127834 | A1 * | 7/2003 | Click | 280/651 |
| 2013/0075989 | A1 * | 3/2013 | Bottazzi | 280/35 |

FOREIGN PATENT DOCUMENTS

| | | | |
|---|---|---|---|
| DE | 3823958 | A1 * | 1/1990 |
| EP | 1702549 | A1 * | 9/2006 |
| EP | 1800796 | A1 * | 6/2007 |
| EP | 2103381 | A1 | 9/2009 |
| EP | 2191934 | A1 * | 6/2010 |
| EP | 2314422 | A1 * | 4/2011 |
| EP | 2371485 | A1 * | 10/2011 |
| FR | 1061371 | | 4/1954 |
| FR | 2928571 | A1 | 9/2009 |
| FR | 2969949 | A1 * | 7/2012 |

* cited by examiner

*Primary Examiner* — Anita M King
(74) *Attorney, Agent, or Firm* — Heslin Rothenberg Farley & Mesiti P.C.

(57) ABSTRACT

A wheeled structure for long arm tools connected to a suction block includes a trolley with a lower platform accommodating the suction block and an upper platform forming a service platform, with a grip handle. A long arm tool support device is positioned and centered on or in a pole connected to the service platform. A tilt device is arranged with a base secured to the service platform and articulatedly accommodates the pole. The base has a rear heel for articulation of a toggle level. The pole is arranged in the upper portion thereof to accommodate a guide pin engaging with an upper end portion of the toggle lever. The pole is arranged to accommodate a column for accommodation of the long arm tool support device. Removing the support device allows the device to tilt to a horizontal position opposite the upper portion of the service platform.

5 Claims, 5 Drawing Sheets

Figure 1:
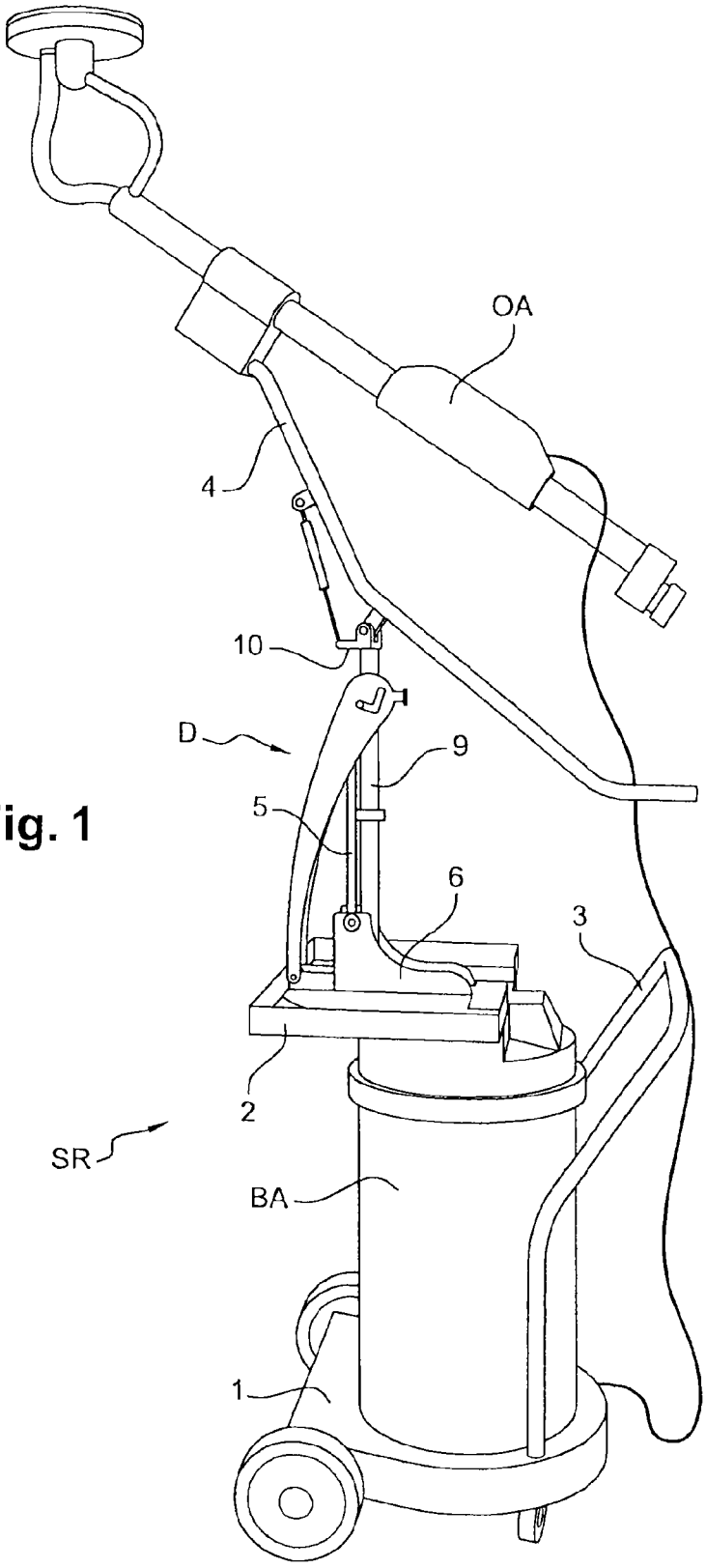

Fig. 4
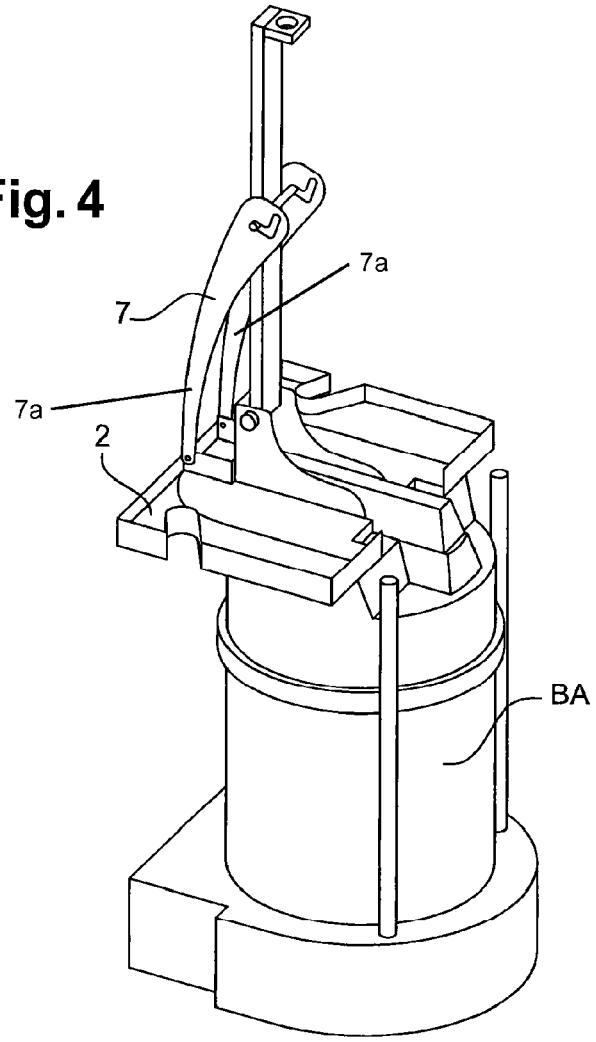
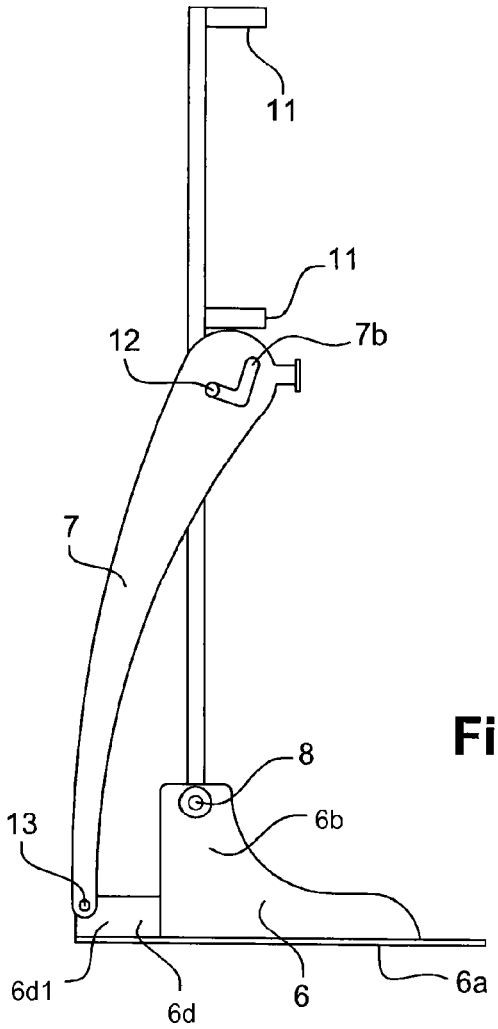
Fig. 5

WHEELED STRUCTURE FOR LONG ARM TOOLS CONNECTED TO A SUCTION BLOCK INCLUDING A TILT DEVICE

CROSS REFERENCE TO RELATED APPLICATIONS

This application claims priority to French application no. 1158487 filed on Sep. 23, 2011, the entire contents of which is hereby incorporated by reference herein.

TECHNICAL FIELD OF THE INVENTION

The invention relates to the technical field of construction, and more specifically to wheeled equipment accommodating long arm tools connected to a suction block. These long arm tools are, for example, long arm sanders for performing sanding operations on walls, ceilings and similar surfaces.

DESCRIPTION OF THE PRIOR ART

The Applicant has brought a large number of innovations to the development of wheeled structures for long arm tools connected to suction blocks in order to improve operator working conditions. Various developments have thus been introduced, for example, for the positioning and articulation of long arm sanders, in working and storage conditions, on wheeled structures. Said structures are fitted with waste suction systems, as described for example in French patent FR 2 928 571. To make it easier to grip these long arm tools which remain bulky and heavy, the Applicant has also developed special fittings to allow the 360° articulation of the long arm sander relative to the wheeled structure, and in a three-dimensional space. This has been described in European patent EP 2 103 381. The Applicant has also taken an interest in building wheeled structures of this kind that afford easy accessibility to the suction block for the purpose of discharging the mass of waste, dust and the like which have been collected. To this end, the Applicant has developed a technical solution as described in French patent FR 1061371. In this particular case, the long arm tool is mounted on a vertically placed column which is detachably secured to an accommodating pole, said pole being associated with a tilt device. This solution is in operation and meets suction block accessibility requirements perfectly. In this particular case, the tilt device, when it is not being acted upon, remains in place above the suction block taking up a significant amount of space.

The approach adopted by the Applicant has been to reconsider the design of a new fitting to the support part of the long arm sander dispensing with problems relating to suction block accessibility, and to do so in the context of a new design for using the wheeled structure.

The solution introduced by the Applicant thus meets this objective in a straightforward, inexpensive manner with a reduced space requirement.

BRIEF SUMMARY OF THE INVENTION

According to a first feature, the wheeled structure for long arm tools connected to a suction block comprising a trolley with a lower platform accommodating the suction block and an upper platform forming a service platform, with a grip handle, said wheeled structure accommodating a long arm tool support device positioned and centred on or in a pole rigidly connected to the service platform, is remarkable in that it comprises a tilt device arranged with a base secured to the service platform and articulatedly accommodating the pole accommodating the long arm tool support device, and in that said base has a rear heel for the accommodation and articulation of a toggle lever, and in that said pole is arranged in the upper portion thereof so as to accommodate a guide pin engaging with the upper end portion of the toggle lever, and in that the pole is arranged to accommodate a column for the accommodation of the long arm tool support device, and in that removing said support device allows the device to tilt to the horizontal opposite the upper portion of the service platform of the wheeled structure.

These characteristics and others will become clearer from the remainder of the description.

BRIEF DESCRIPTION OF THE DRAWING FIGURES

Figure 2:
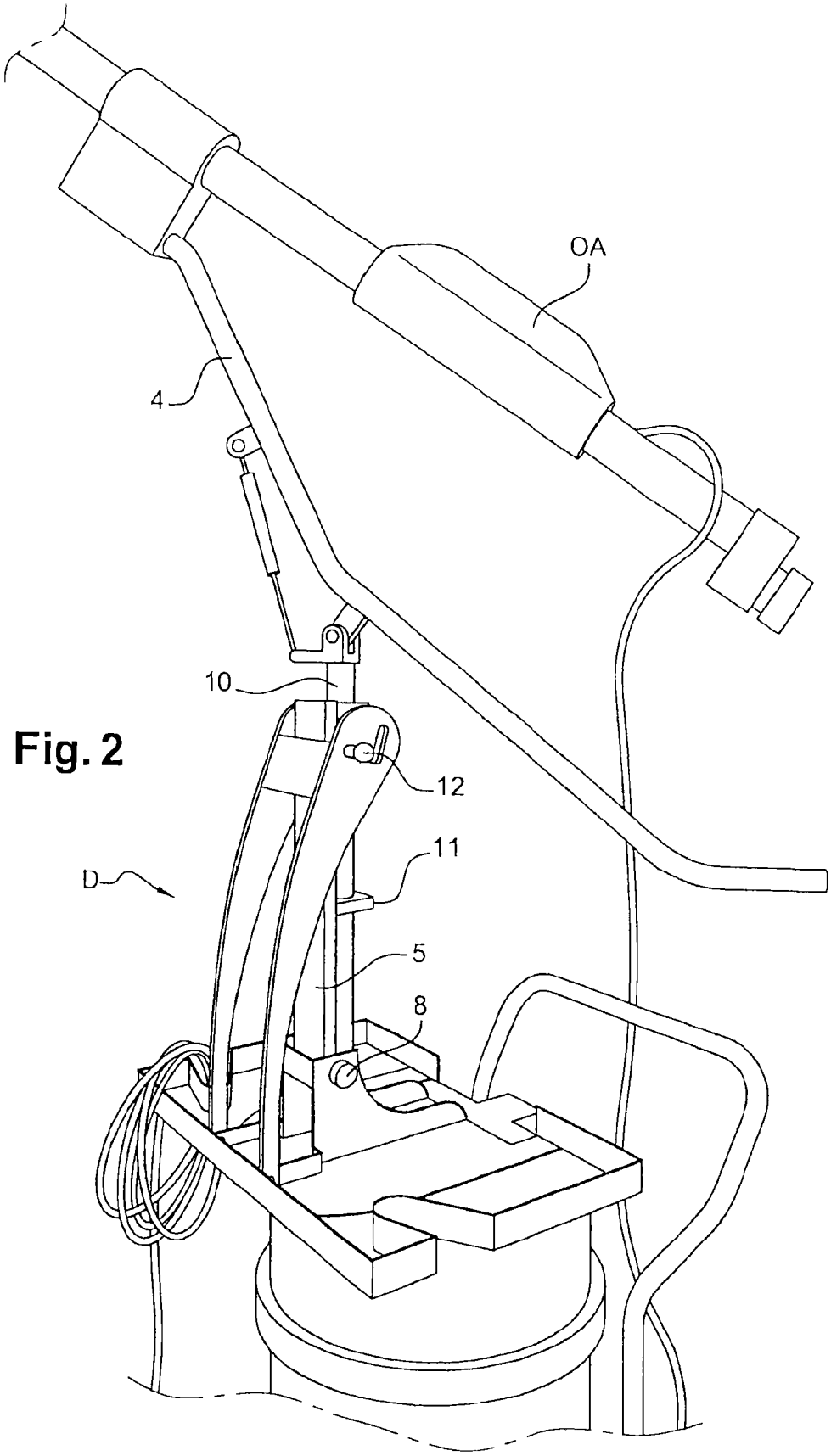
Figure 3:
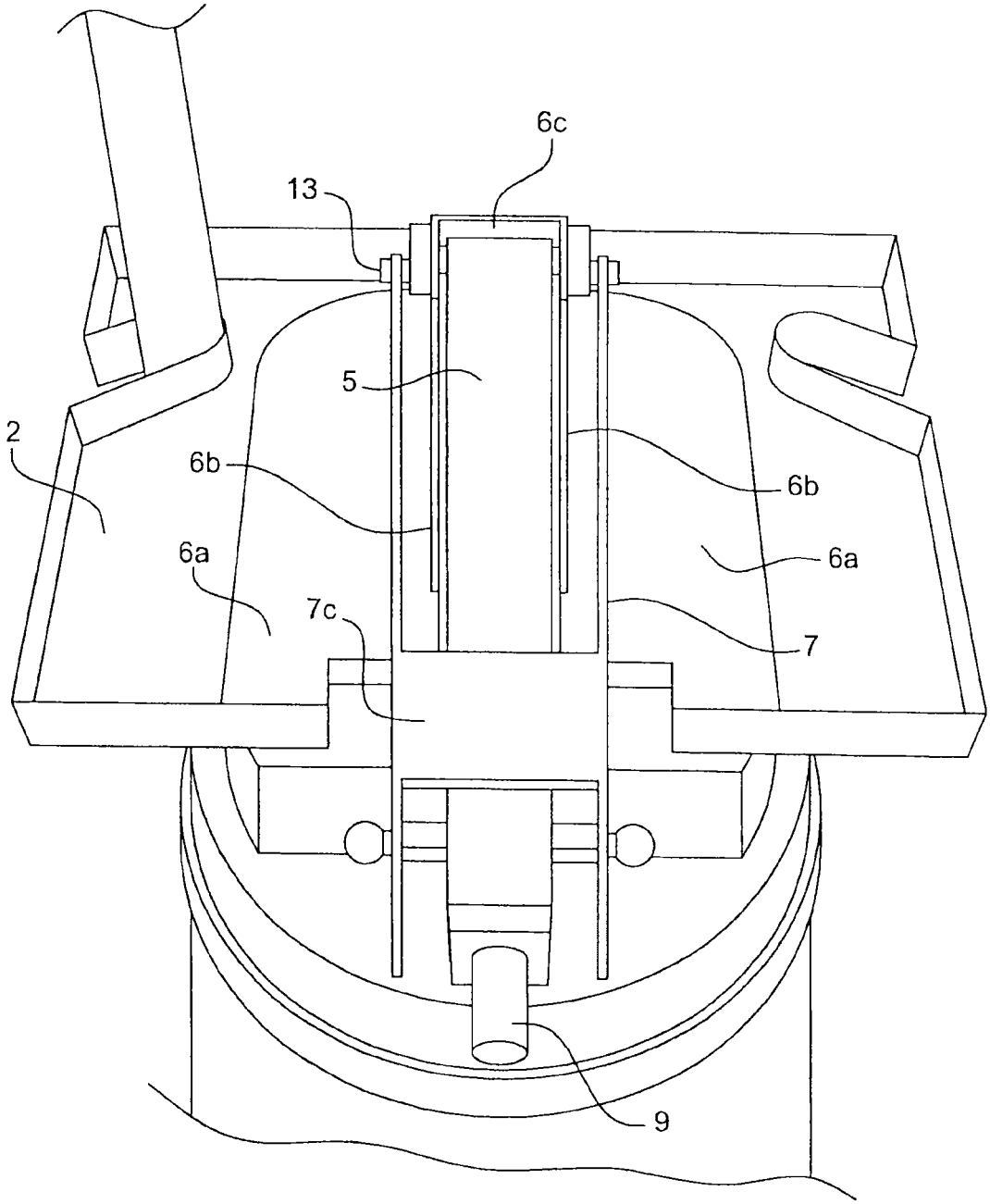
Figure 6:
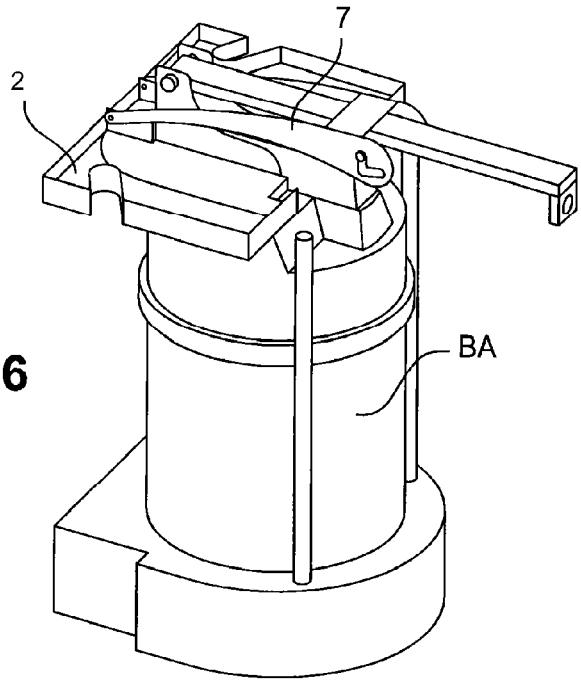
Figure 7:
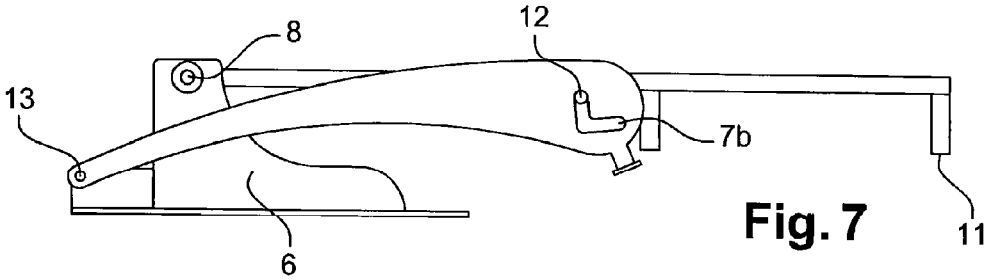
Figure 8:
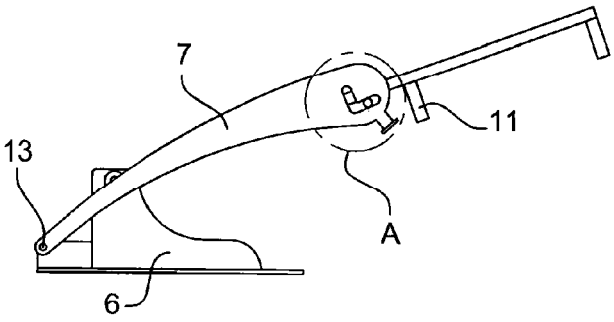
Figure 9:
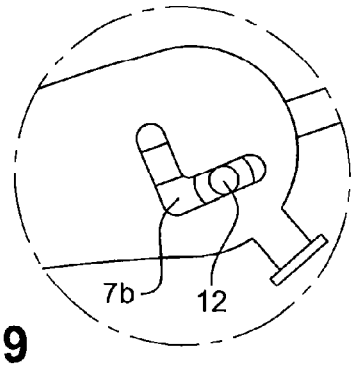

The object of the invention is set as shown non-restrictively in the drawing figures, wherein FIG. 1 is a view showing a wheeled structure for a long arm sander connected to a suction block and including an inventive tilt device, supporting the device for holding, handling and steering the long arm sander, FIG. 2 is a partial large-scale view showing the inventive tilt device, the device being shown in the raised position in order to accommodate the support of the device for holding, handling and steering the long arm sander, FIG. 3 is a partial large-scale view basically showing the tilt device in the lowered position after the long arm sander is removed, FIG. 4 is a partial diagrammatic view in perspective showing in accordance with the inventive principle the tilt device in the deployed position secured to the upper portion of the suction block, the column for the accommodation of the long arm tool support device not being shown, FIG. 5 is a diagrammatic side view showing in accordance with the inventive principle with only the tilt device in the deployed situation according to FIG. 4, FIG. 6 is a partial diagrammatic view in perspective showing the tilt device in the foldaway position secured to the upper portion of the suction block, the column for the accommodation of the long arm tool support device not being shown, FIG. 7 is a diagrammatic side view showing in accordance with the inventive principle only the tilt device when folded away according to FIG. 6, FIG. 8 is a partial diagrammatic side view showing in accordance with the inventive principle the tilt device in an intermediate position to FIGS. 4 and 6, FIG. 9 is a larger-scale detail view of the circled part identified as (A) in FIG. 8.

DETAILED DESCRIPTION

To make the object of the invention more concrete, it is now described non-restrictively as shown in the drawing figures.

The wheeled structure is defined in its entirety as (SR) and is designed to accommodate a suction block with bag (BA). The wheeled structure comprises a trolley with a lower platform (1) accommodating the suction block and an upper platform (2) forming a service platform. A grip handle (3) is associated with the wheeled structure so that it can be guided and handled. This wheeled structure, able to accommodate a long arm tool (OA), such as a long arm sander, well known as such and identified in a large number of patents from the Applicant, including those aforementioned. The invention is not restricted just to the long arm sander, but other long arm tools may be used as embodiments of the invention. A flexible connection extends between the long arm tool and the suction block (BA).

The long arm tool or long arm sander is mounted on a support device (4) made for example in the form of a tubular section of great length able to constitute an operating and steering handle for the operator. In a known way, also, the support device (4) is able to be positioned and centred on or in a pole (5) which is secured and held in position relative to the service platform of the wheeled structure.

The invention relates to the design of a tilt device (D) for the accommodation of the device (4) associated with the long arm tool or long arm sander. As shown in the drawings, the tilt device comprises a base (6) secured to the upper portion of the service platform (2) of the wheeled structure. This base (6) has a horizontal bearing plate (6*a*), intended to be secured by being bolted or the like to the upper portion of the service platform. Said base also has two flange-forming spaced apart parallel lateral wings (6*b*), for the internal positioning of the pole (5) accommodating the support device of the long arm tool (OA). Said wings (6*b*) are braced by a transverse bottom connection plate (6*c*), giving a U-shaped and therefore forward-opening configuration on the grip handle side (3). Said base (6) is then extended rearward by a heel (6*d*) including two additional spaced apart parallel wings (6*d*1) for positioning and articulating a toggle lever (7). The pole (5) is pivotably mounted at its base on a pin (8) placed between the wings (6*b*) with appropriate bolting means allowing free articulation. This pole is shaped and accommodates internally or externally a column (9) able to accommodate the long arm tool support device (4) provided to this end with a sleeve (10) able partially to penetrate over a pre-set length into said column (9). In the event of said column being exposed relative to the pole, clamping means (11) are used to connect them. The column (6) and the pole (5) may be connected in any appropriate manner.

In the upper portion thereof, the pole (5) is arranged to accommodate crosswise a guide pin (12) protruding on either side laterally on each side of the pole. Furthermore, the toggle lever (7) is pivotably mounted at its base on a pin (13) placed between wings (6*d*1) formed on the rear heel portion (6*d*) of the base (6). Said toggle lever thus has two spaced apart parallel flanges (7*a*) which define a space in which the pole (5) is able to pass. Near to each of the upper ends thereof, the flanges (7*a*) each have an angled L-shaped aperture (7*b*) passed through by the guide pin (12) which includes locking means at the ends thereof. A close connection is thus obtained for the tilt device between the pole (5), the toggle lever (7) and the base (6). The guide pin (12) depending on the positions of the tilt device (D) is thus able to take up differentiated positions in each of the apertures (7*b*) as shown in FIGS. 4 to 9.

The flanges (7*a*) of the tilt device (7) may be braced by one or more transverse connection plates (7*c*), as is shown for example in FIG. 2.

The solution introduced by the Applicant is therefore extremely practical in terms of installing or removing the long arm tool or long arm sander. Installation of the long arm tool is thus simplified, the tilt device (D) generates a reduced space requirement, and with the long arm tool removed, when said device is tilted into a horizontal position, in a plane above the service platform of the wheeled structure, it remains in the volume defined with the grip handle.

In this particular case, the suction block becomes accessible in a conventional manner by removing the service platform structure block relative to the external casing or housing internally accommodating the bag part of the suction assembly.

The invention claimed is:

1. Wheeled structure for a long arm tool comprising a trolley with an upper platform forming a service platform, with a grip handle, said wheeled structure accommodating a long arm tool support device positioned and centered on or in a pole connected to the service platform, and further comprising a tilt device arranged with a base secured to the service platform and articulatedly accommodating the pole accommodating the long arm tool support device, wherein said base has a rear heel for accommodation and articulation of a toggle lever, an upper portion of said pole is arranged to accommodate a guide pin engaging with an upper end portion of the toggle lever, the pole is arranged to accommodate a column for accommodation of the long arm tool support device, and wherein removing said support device allows the tilt device to tilt to a horizontal position opposite an upper end of the service platform of the wheeled structure.

2. Wheeled structure as claimed in claim 1, wherein the base has a bearing plate rigidly connected to the service platform, and comprises two flange-forming spaced apart parallel lateral wings for internal positioning of the accommodating pole, said wings being braced by a transverse bottom plate defining a U-shaped configuration and the base being forward opening on a side of the handle, and the base is extended rearward by the heel including two additional spaced apart parallel wings to allow positioning and articulation of the toggle lever, and the pole is pivotably mounted at its base on a pin placed between the wings of the base.

3. Wheeled structure as claimed in claim 1, wherein said support device comprises a sleeve that penetrates into the column.

4. Wheeled structure as claimed in claim 1, wherein the toggle lever has two spaced apart parallel flanges defining a space for the pole to pass through, said flanges being arranged near to an upper end thereof with an angled L-shaped aperture, allowing the guide pin associated with the pole to pass through, the flanges being braced by one or more connection plates.

5. Wheeled structure as claimed in claim 1, wherein the long arm tool is connected to a suction block, and the trolley has a lower platform accommodating the suction block.

* * * * *